United States Patent [19]

Laurin

[11] 4,047,841

[45] Sept. 13, 1977

[54] PROPELLER BLADING FOR A SELF-ADJUSTING PROPELLER FOR BOATS

[75] Inventor: Arvid Laurin, Skaldinge, Sweden

[73] Assignee: AB Jarnforadling, Halleforsnas, Sweden

[21] Appl. No.: 628,734

[22] Filed: Nov. 4, 1975

[30] Foreign Application Priority Data

Nov. 15, 1974 Sweden ..... 7414374

[51] Int. Cl.[2] ..... B63H 1/26

[52] U.S. Cl. ..... 416/140

[58] Field of Search ..... 416/140, 135, 242

[56] References Cited

U.S. PATENT DOCUMENTS

| | | | |
|---|---|---|---|
| 608,265 | 8/1898 | Olsen | 416/140 |
| 793,373 | 6/1905 | Hill | 416/140 |
| 1,520,746 | 12/1924 | Boyce et al. | 416/140 |
| 1,600,654 | 9/1926 | Stodder | 416/140 |
| 2,005,343 | 6/1935 | Kent | 416/135 |
| 2,131,217 | 9/1938 | Brumwell | 416/140 |
| 2,134,157 | 10/1938 | Thompson | 416/140 |
| 2,282,077 | 5/1942 | Moore | 416/89 |
| 2,283,774 | 5/1942 | Thompson | 416/140 |
| 2,322,352 | 6/1943 | Frazier | 416/140 |

FOREIGN PATENT DOCUMENTS

| | | | |
|---|---|---|---|
| 686,013 | 12/1939 | Germany | 416/140 |
| 358,771 | 4/1938 | Italy | 416/140 |
| 22,441 | 10/1912 | United Kingdom | 416/237 |
| 434,604 | 9/1935 | United Kingdom | 416/140 |

*Primary Examiner*—Everette A. Powell, Jr.
*Attorney, Agent, or Firm*—Wenderoth, Lind & Ponack

[57] ABSTRACT

A self-adjusting propeller for sailing-boats comprises a propeller body mounted on a drivable rotary shaft and propeller blades rotatably mounted on the propeller body. These propeller blades are arranged, on movement of the boat in the water when the propeller is stationary, to assume a neutral position, while when the shaft is driven, they assume positions of rotation determined by stopping abutments for driving with the propeller. Each propeller blade is in this case so designed that the position line for the center of pressure along the propeller blade forms an arc from the shaft, the arc cutting the axis of rotation of the propeller blade a distance from the tip of the blade such that when the shaft is driven, the outer portion of the propeller blade provides a moment which counteracts the directed moment when the propeller is stationary.

5 Claims, 5 Drawing Figures

PROPELLER BLADING FOR A SELF-ADJUSTING PROPELLER FOR BOATS

BACKGROUND OF THE INVENTION

The present invention relates to propeller blading for a self-adjusting propeller for sailing-boats which comprises a propeller body mounted on a drivable rotary shaft with propeller blades rotatably mounted at the propeller body and arranged, on movement of the boat in the water when the propeller is stationary, to assume the neutral position. Furthermore, the propeller blades are coupled to the shaft by transmission means such that, when the shaft is driven, they assume rotation positions determined by stopping abutments or like means, for driving with the propeller. In the propeller blading according to the invention, the position line of the centre of pressure along the propeller blade forms an arc from the shaft, the arc cutting the axis of rotation of the propeller blade a distance from the tip of the blade such that, at the rotation of the shaft, the outer portion of the propeller blade provides a moment which counteracts the directed moment when the propeller is stationary. In the invention, use is made of the difference in velocity distribution along the blade of the propeller when the propeller is stationary and when it is driven. Thus, it is possible, on the basis of the force increasing on rotation by the power of two from the centre to the blade tip, to obtain a sufficient excess moment for turning the blade on rotation, while obtaining a large directing moment when the propeller is stationary. Thus, the present invention has obviated the disadvantages in prior art self-adjusting propellers in which the directing moment for the neutral position is small at the same time as the stop positions for forward and reverse movement are not always stable. The reason for this is that a self-adjusting propeller must, in order to possess reliable maneuvrability at low speed, place the propeller blades in the neutral position (the sailing position) and in a reliable rest position against stops or the like which determine the pitch for forward and reverse movement.

BRIEF DESCRIPTION OF THE DRAWINGS

The invention will be described in greater detail hereinbelow with reference to the accompanying drawing showing a self-adjusting propeller including an embodiment of the propeller blade according to the invention chosen by way of example.

In the drawings.

DETAILED DESCRIPTION OF THE INVENTION

The propeller body 1 is rotatably journaled on the rotary shaft 2 connected to the ship motor. Two or more propeller blades 3 are in turn rotatably journaled on the propeller body such that they assume a neutral position on movement of the boat in the water when the shaft 2 is not being driven and the boat is thus being powered by the wind.

The propeller blades 3 are coupled to the shaft 2 by transmission means such that, when the shaft is driven, they assume rotation positions determined by stops or the like for driving with the propeller. The transmission means includes conical gear wheels of which one is non-rotatably connected to the shaft 2. The remaining gear wheels are integral with the propeller blades 3 and are located inside the journaling of the blades on the propeller body 1.

Figure 4:
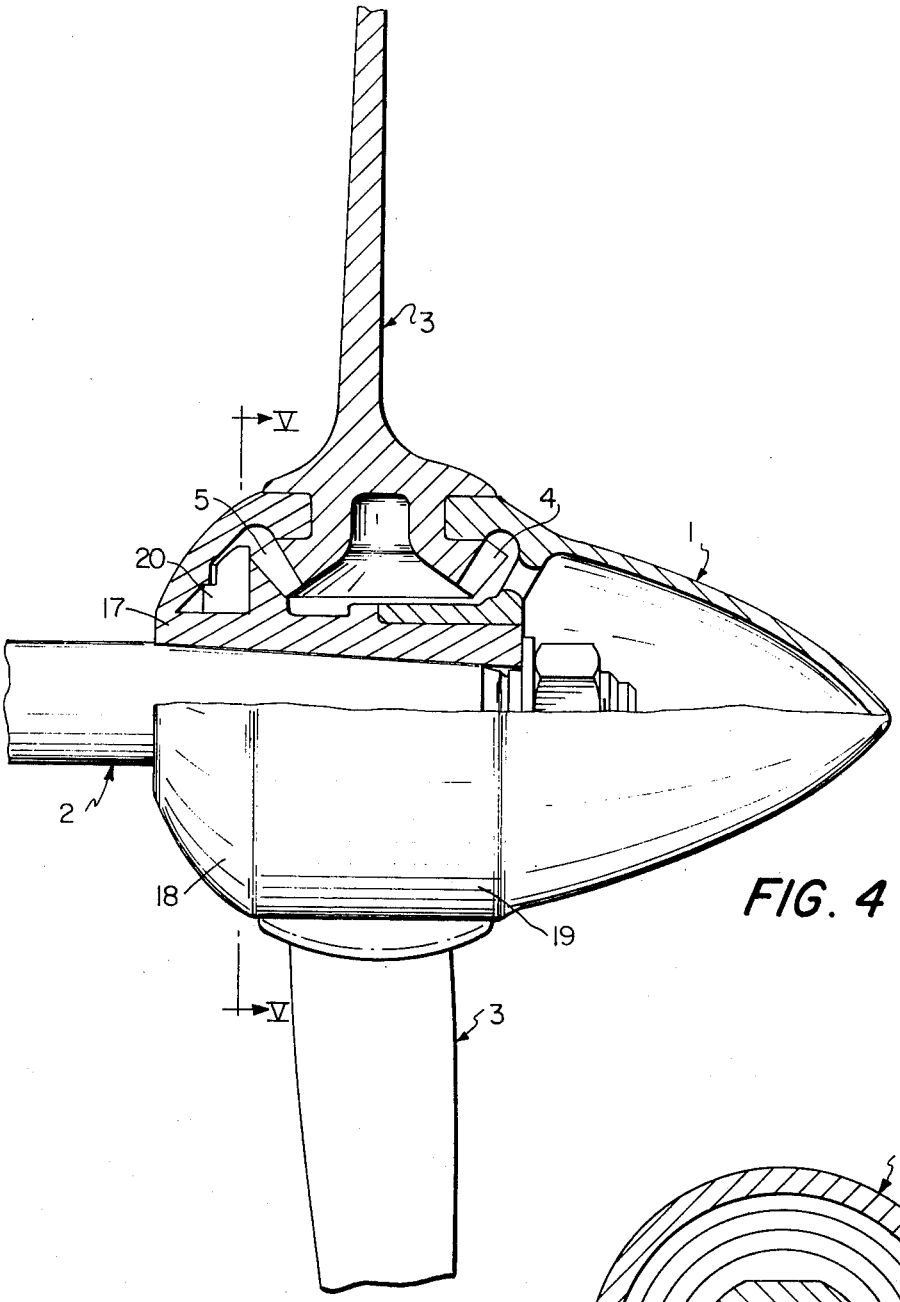
FIG. 4 is a side view, in partial section, of the propeller.
Figure 5:
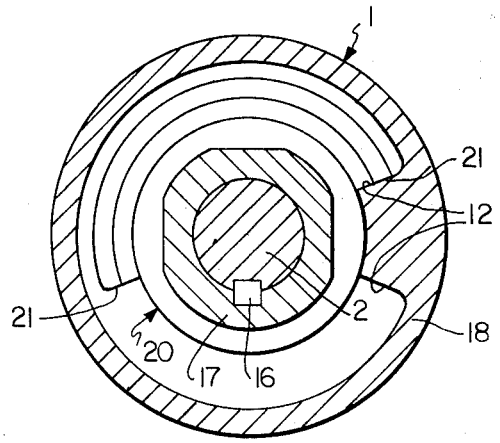
FIG. 5 is a section taken along line V—V in FIG. 4.

With reference to FIGS. 4 and 5, gear wheel 5 is non-rotatably connected to drive shaft 2, e.g. by means of a key 16, while gear wheels 4 are formed integrally with propeller blades 3 and positioned within mounts in propeller housing 1.

More specifically, propeller housing 1 is mounted on a part 17, which includes gear wheel 5 and which is fixed to drive shaft 2. Propeller housing 1 is shown to include a front part 18 and a rear part 19, that are joined to each other through a number of axially extending screws that are not shown.

A replaceable element 20 is provided for changing the angle of pitch of propeller blades 3 in connection with the operation of shaft 2. As shown in the drawings, replaceable element 20 is an element which is non-rotatably fixed to drive shaft 2, and which has at least one abutment surface 21, each arranged to engage a corresponding stop surface 12 on propeller housing 1. Replaceable element 20 is a plate-shaped member non-rotatably mounted on drive shaft 2 and having abutment surfaces 21. As shown in FIG. 5, stop plate 20 has a non-circular opening therethrough corresponding to the outer configuration of part 17 provided with gear wheel 5.

Replaceable element 20 is provided with two abutment surfaces 21 for engaging a stop having stop surfaces 12 on propeller housing 2. One of abutment surfaces 21 is used during the forward drive operation, while other abutment surface is used during a reverse drive operation. Different parts 20 having different annular distances between abutment surfaces 21 can be installed in the propeller.

According to another embodiment, the replaceable part 20 can be made in the form of a gear wheel fixed to drive shaft 2 and provided with abutment surfaces. Part 17 having thereon gear wheel 5 can thus be provided with an abutment surface or surfaces 21. Thus, in principle, stop plate 20 is integrally formed with part 17 provided with gear wheel 5. Thus, the transmission includes a replaceable portion for changing the pitch of the propeller blades 3 when the shaft 2 is in operation.

Figure 1:
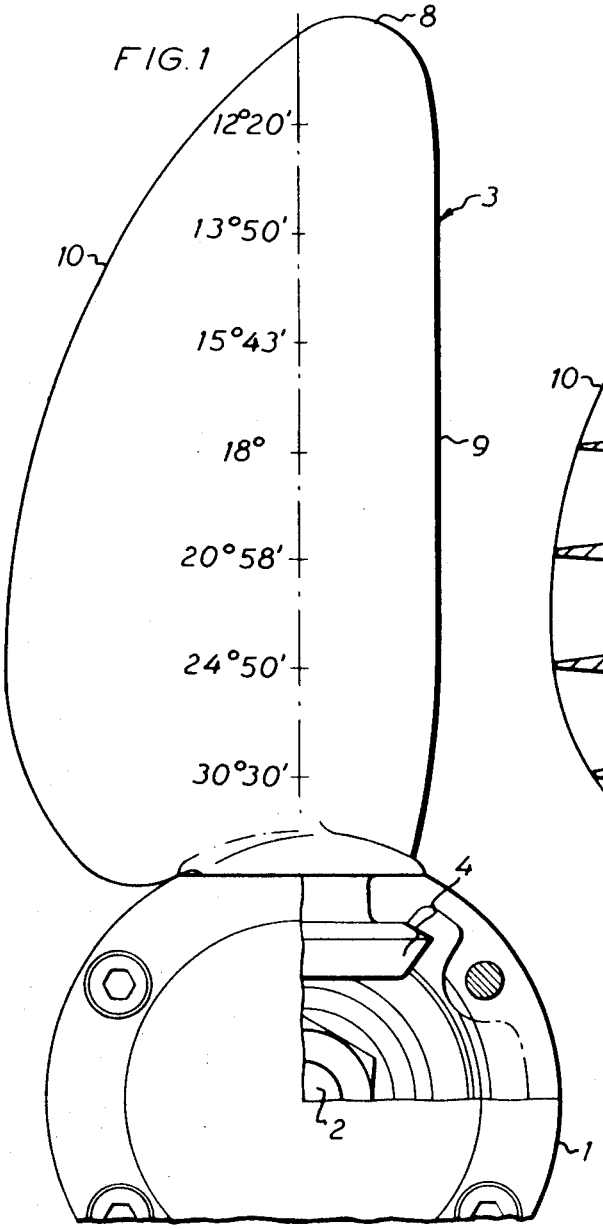
FIG. 1 shows a portion of the propeller seen from the rear and in partial section.
Figure 3:
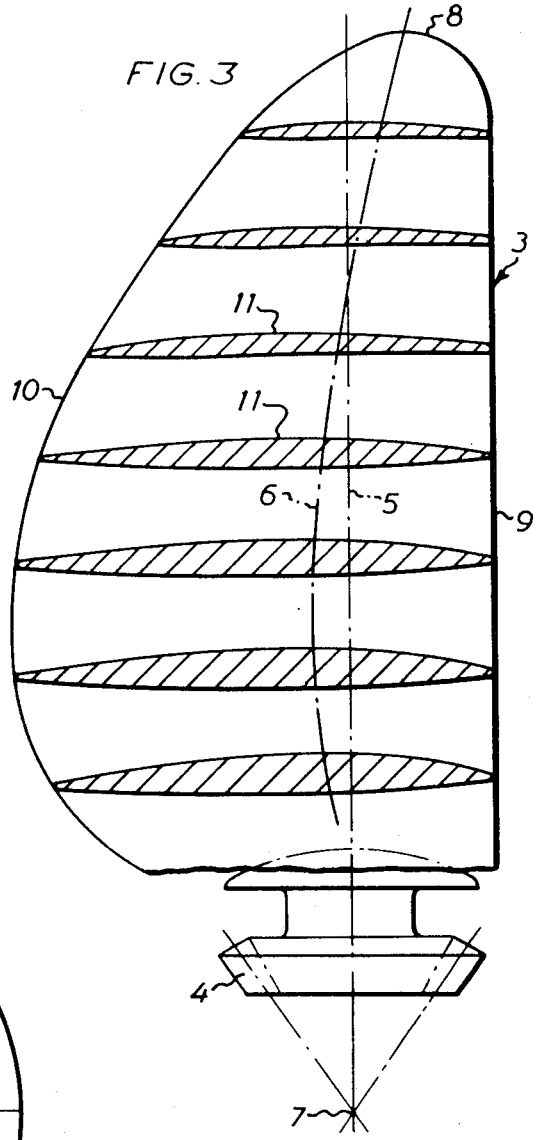
FIG. 3 shows the propeller blade in a flattened plane with sections of the profile of the blade.
Figure 2:
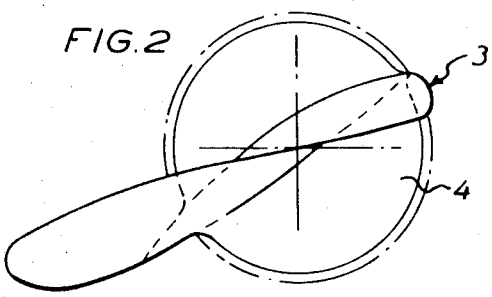
FIG. 2 is an end elevation of the propeller blade forming part of the propeller.

In FIG. 3, which shows the propeller blade 3 in the flattened state, the axis of rotation of the propeller blade 3 is designated 5 and the position line of the centre of pressure along the propeller blade 3 is designated 6. In order to establish the position line 6, FIG. 3 has been provided with a number of sections of the profile of the propeller blade 3, these sections being spaced apart by a distance which is equal to a tenth of the radial extent of the blade from the centre 7 of the shaft 2. The sections correspond to the points in FIG. 1 for which the pitches are indicated. Naturally, these sections could be selected in some other way. The position line 6 runs through the centre of pressure of each section, that is to say it runs through those points of each of the profile sections where the blade thickness is greatest.

The position line 6 forms an arc from the shaft 2, the arc cutting the axis of rotation 5 of the propeller blade 3 at a point a distance from the blade tip 8. As a result, on rotation of the shaft 2, the outer portion of the propeller blade 3 provides a moment which counteracts the directed moment when the propeller is stationary. According to a preferred embodiment, the outer portion of the propeller blade 3 is arranged to provide a moment, on driving of the shaft 2, which is of approximately the same size as the directed moment when the propeller is stationary.

As is apparent from the drawing, the arc constituting the position line 6 cuts the axis of rotation 5 of the propeller blade 3 a distance from the blade tip 8 which is approximately on quarter of the distance between the tip 8 and the centre 7 of the shaft 2.

In order to enable the propeller blade 3 to provide the contemplated effect, the cutting edge 9 of the blade, which is normally called the leading edge, should be substantially straight, whereas the following edge 10, which is normally called the trailing edge, should be curved. In this case, the position line 6 should be a distance from the leading edge 9 equal to 35–45%, suitably 35–38% of the distance between the leading edge 9 and the trailing edge 10, as measured along cross-sectional planes perpendicular to the axis of rotation of the propeller blade.

The propeller shown on the drawings rotates to the right, and the upwardly facing sides of the sections of the profile of the blade 3 refer to the front face of the blade. Thus, the outer portion of the position line 6 can be considered as pivoting over the axis of rotation 5 of the blade 3 in the rotational direction of the propeller.

The invention is not restricted to that described above and illustrated on the drawings but may be modified within the spirit and scope of the appended claims.

What I claim and desire to secure by Letters Patent is:

1. A self-adjusting sailing ship propeller system comprising:

a drive shaft rotatable in opposite directions;

a propeller body mounted on said drive shaft and rotatable therewith;

a plurality of propeller blades rotatably mounted on said propeller body;

each said propeller blade being freely rotatable about an axis of rotation to a neutral position when said drive shaft is stationary, and to respective forward or reverse pitch drive positions when said drive shaft is rotated in the forward or reverse directions, respectively;

means within said propeller body to limit said forward or reverse pitch drive positions of said propeller blades;

each said propeller blade having a configuration such that a center line of pressure thereof, formed by connecting points of greatest blade thickness taken in cross-sectional planes perpendicular to said axis of rotation, forms an arc which intersects said axis of rotation at a distance from the tip of said blade such that an outer portion of said propeller blade forms means for providing a moment acting on said propeller blade, upon the driving of said drive shaft, which is approximately equal to and which counteracts a directed moment causing said propeller blade to assume said neutral position when said drive shaft is stationary.

2. A propeller system as claimed in claim 1, wherein said arc formed by the position line of the center of pressure along said propeller blade intersects said axis of rotation of said propeller blade at a distance from the tip of said propeller blade which is approximately one quarter of the distance between said tip and the center of said drive shaft.

3. A propeller system as claimed in claim 1, wherein each said propeller blade has a straight leading edge and a curved trailing edge.

4. A propeller system as claimed in claim 1, wherein said arc formed by the position line of the center of pressure along said propeller blade is located a distance from said leading edge which is 35-45% of the distance between said leading edge and said trailing edge, as measured along each of said cross-sectional planes.

5. A propeller system as claimed in claim 4, wherein said arc is located a distance from said leading edge which is 35–38% of the distance between said leading edge and said trailing edge.

* * * * *